US006698671B1

(12) United States Patent
Chen

(10) Patent No.: US 6,698,671 B1
(45) Date of Patent: Mar. 2, 2004

(54) MOVABLE SHIELD STRUCTURE OF A FLOW CONTROL VALVE ROD OF A PISTOL-TYPE NOZZLE

(75) Inventor: Chin-Yuan Chen, Chang-Hua Hsien (TW)

(73) Assignee: Shin Tai Spurt Water of the Garden Tools Co., Ltd., Chang-Hua Hsien (TW)

( * ) Notice: Subject to any disclaimer, the term of this patent is extended or adjusted under 35 U.S.C. 154(b) by 0 days.

(21) Appl. No.: 10/320,784

(22) Filed: Dec. 17, 2002

(51) Int. Cl.[7] ..... B05B 7/02
(52) U.S. Cl. ..... 239/525; 526/600
(58) Field of Search ..... 239/525, 526, 239/529, 530, 390, 397, 600

(56) References Cited

U.S. PATENT DOCUMENTS 3,944,141 A * 3/1976 Siczek ..... 239/288.5
4,880,143 A * 11/1989 Murray et al. ..... 222/135
5,618,001 A * 4/1997 Del Gaone et al. ..... 239/346
5,791,564 A * 8/1998 Carra ..... 239/526
5,839,621 A * 11/1998 Tada ..... 222/383.1
5,881,997 A * 3/1999 Ogawa et al. ..... 251/335.2
6,000,581 A * 12/1999 Woodruff ..... 222/327
6,412,662 B1 * 7/2002 Bryan et al. ..... 222/146.5
6,415,958 B1 * 7/2002 Donley ..... 222/146.5
6,439,481 B2 * 8/2002 von Schuckmann ..... 239/333

FOREIGN PATENT DOCUMENTS

JP 409070557 A * 3/1997

* cited by examiner

*Primary Examiner*—William C. Doerrler
*Assistant Examiner*—Mohammad M. Ali
(74) *Attorney, Agent, or Firm*—Harrison & Egbert

(57) ABSTRACT

A pistol-type nozzle includes a handle, a barrel, a flow control valve rod with an adjustment nut fastened thereon, a trigger lever provided with a trigger portion and pivoted with the handle, and a movable shield pivoted with the trigger lever to provide the flow control valve rod, the adjustment nut, and the trigger portion of the trigger lever with protection against dust and rust.

4 Claims, 4 Drawing Sheets

MOVABLE SHIELD STRUCTURE OF A FLOW CONTROL VALVE ROD OF A PISTOL-TYPE NOZZLE

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a pistol-type spray nozzle and more particularly to a movable shield structure of a flow control valve rod the pistol-type spray nozzle.

BACKGROUND OF THE INVENTION

The conventional pistol-type nozzle comprises a flow control valve rod, and an adjustment nut which is rotatably mounted on the flow control valve rod for adjusting the water flow of the pistol-type nozzle. The flow control valve rod and the adjustment nut are not shielded and are therefore susceptible to rust formation and dust deposits. In addition, the naked or exposed flow control valve rod and adjustment nut undermine the esthetic effect of the pistol-type nozzle.

SUMMARY OF THE INVENTION

The primary objective of the present invention is to provide a pistol-type nozzle with a movable shield structure which is intended to provide a flow control valve rod and an adjustment nut of the pistol-type nozzle with protection against dust and rust.

It is another objective of the present invention to provide a pistol-type nozzle with a movable shield structure which is designed to hide a flow control valve rod and an adjustment nut of the pistol-type nozzle from view so as to enhance the esthetic effect of the pistol-type nozzle.

The features, functions, and advantages of the present invention will be more readily understood upon a thoughtful deliberation of the following detailed description of a preferred embodiment of the present invention with reference to the accompanying drawings.

DETAILED DESCRIPTION OF THE INVENTION

Figure 1:
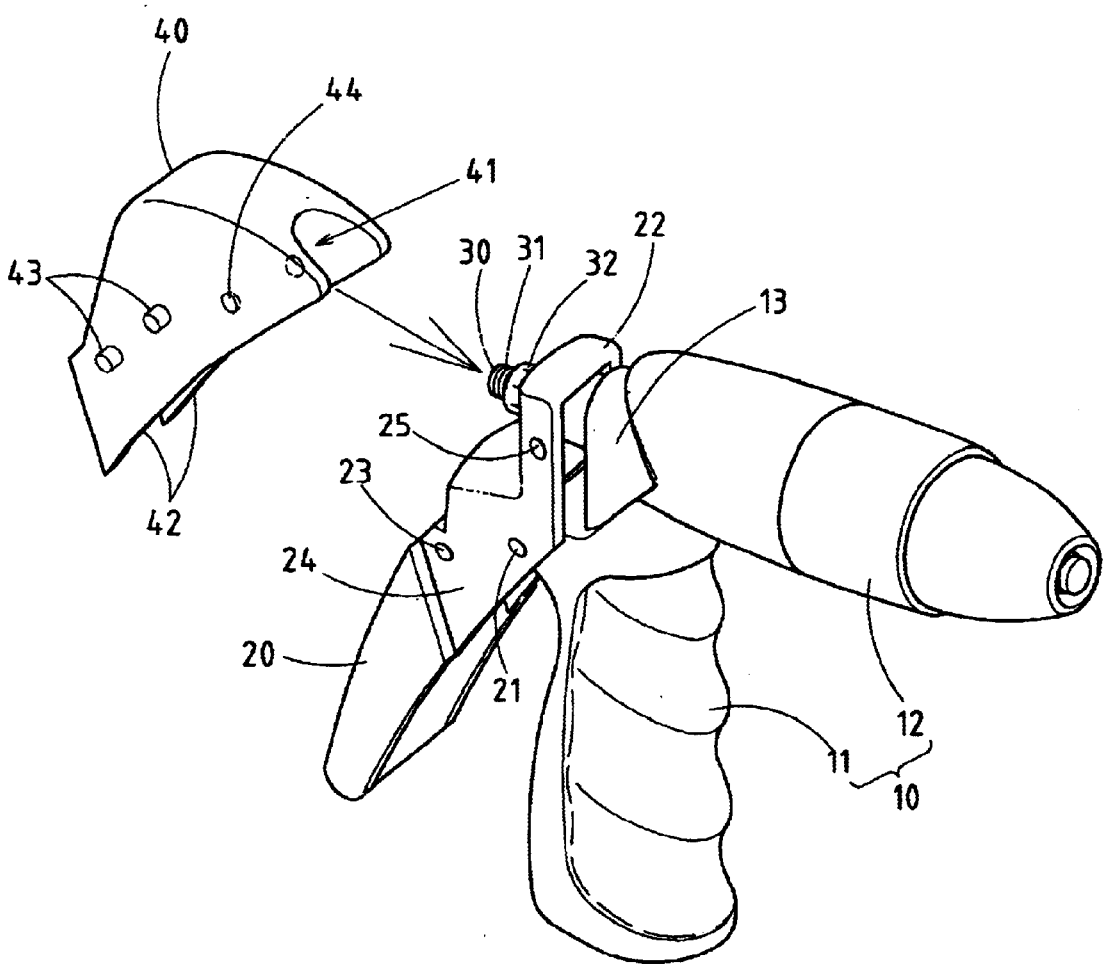
FIG. 1 shows an exploded perspective view of the preferred embodiment of the present invention.

As shown in FIGS. 1–4, a pistol-type nozzle of the preferred embodiment of the present invention comprises a main body 10, a trigger lever 20, and a flow control valve rod 30, and a movable shield 40.

The main body 10 is formed of a handle 11 and a barrel 12.

The trigger lever 20 is pivotally fastened at the top end with the rear side of the top end of the handle 11 by a pivot 21. The trigger lever 20 is provided at the top end with a trigger portion 22.

The flow control rod 30 is extended out of the rear end of the barrel 12 and is provided with a threaded segment 31 on which an adjustment nut 32 is mounted in such a way that it can be turned with the thumb and the forefinger to adjust the water flow, and that it is in contact with the trigger portion 22 of the trigger lever 20. As the trigger lever 20 is moved by an external force toward the handle 11, the trigger portion 22 of the trigger lever 20 moves in the opposite direction to push the adjustment nut 32, thereby resulting in a rearward displacement of the flow control rod 30 to open up the water flow path of the barrel 12.

Figure 2:
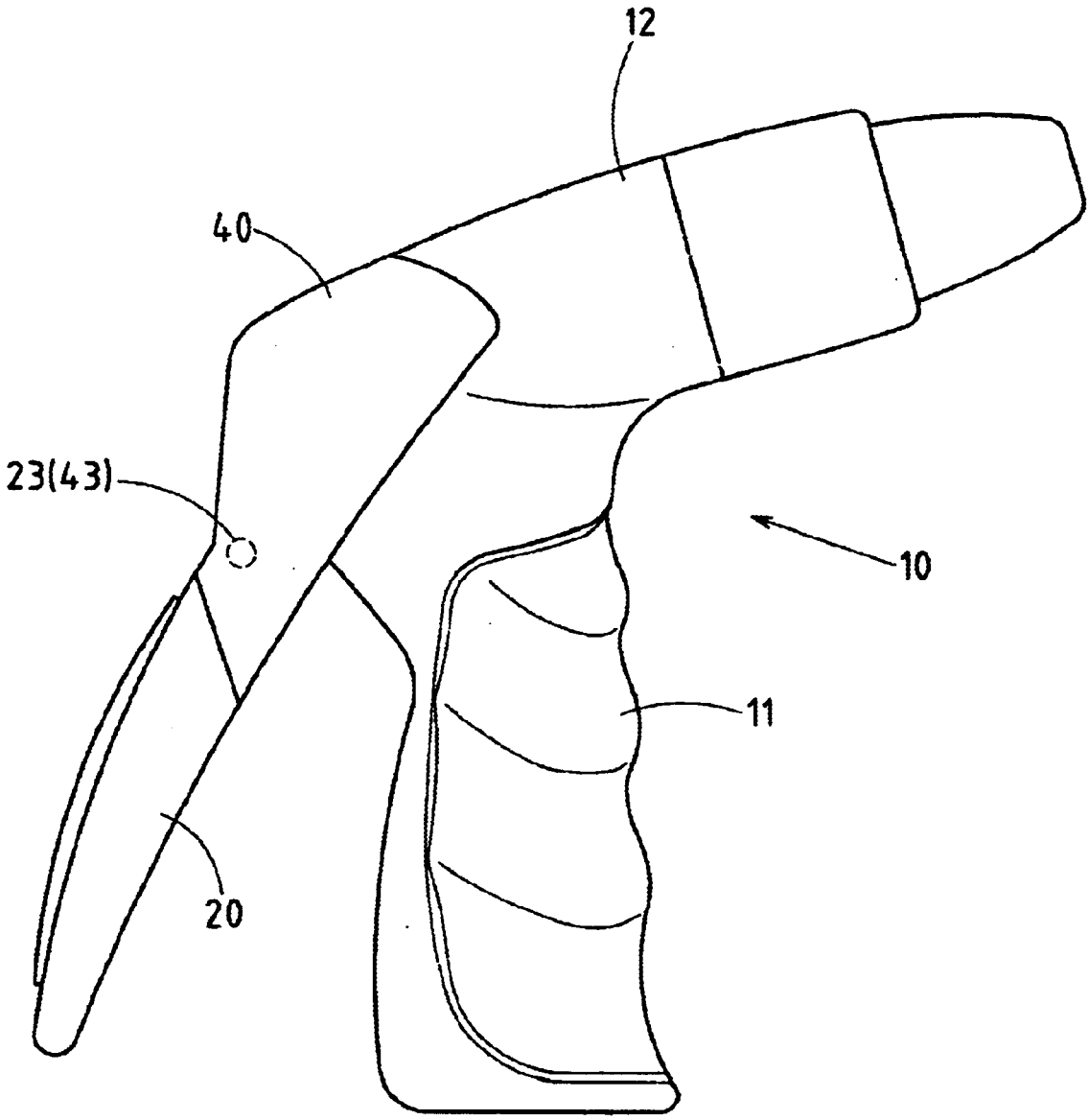
FIG. 2 shows a side schematic view of the preferred embodiment of the present invention.
Figure 3:
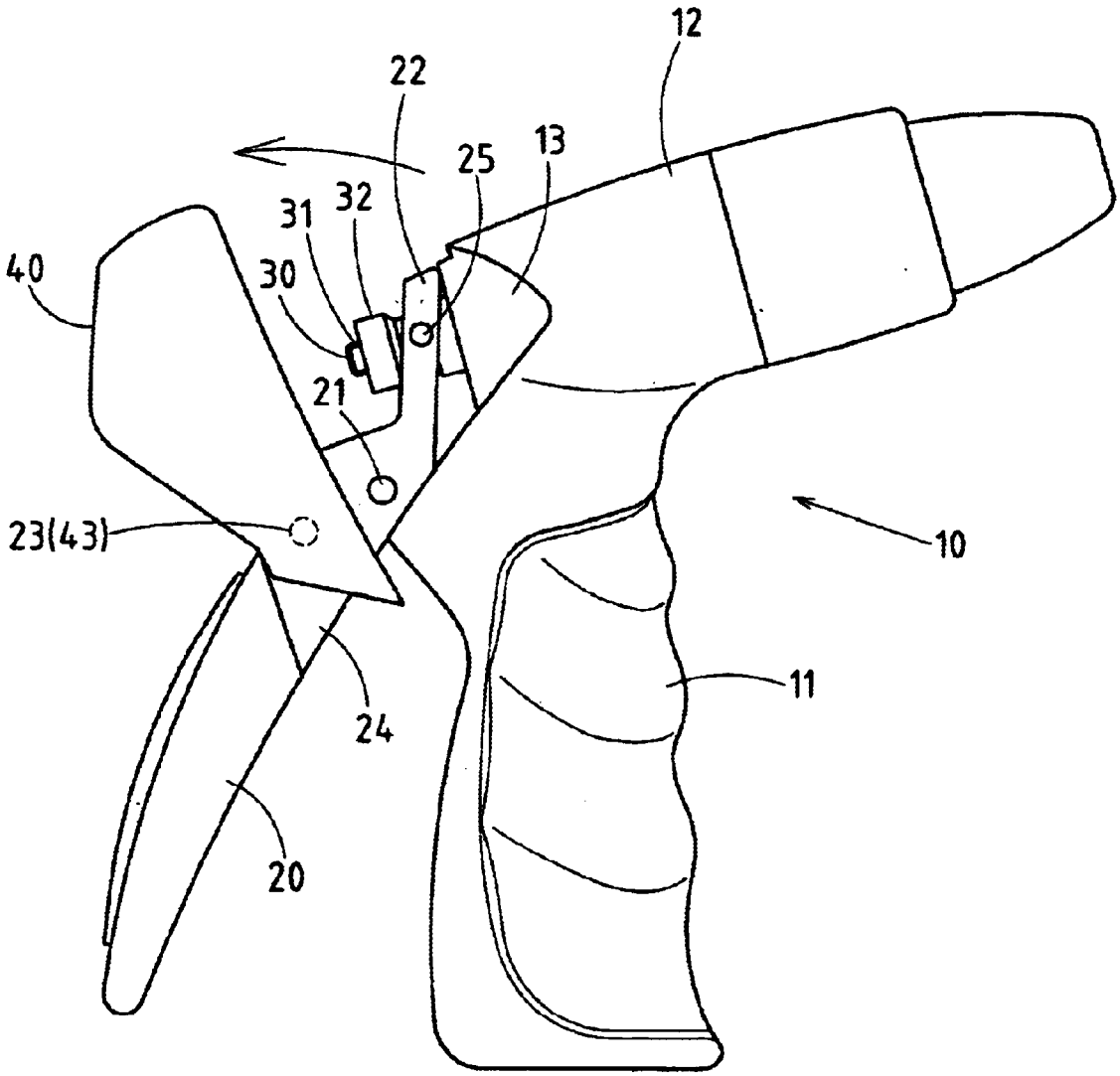
FIG. 3 shows a side schematic view of the preferred embodiment of the present invention with the movable shield structure being in an open state.
Figure 4:
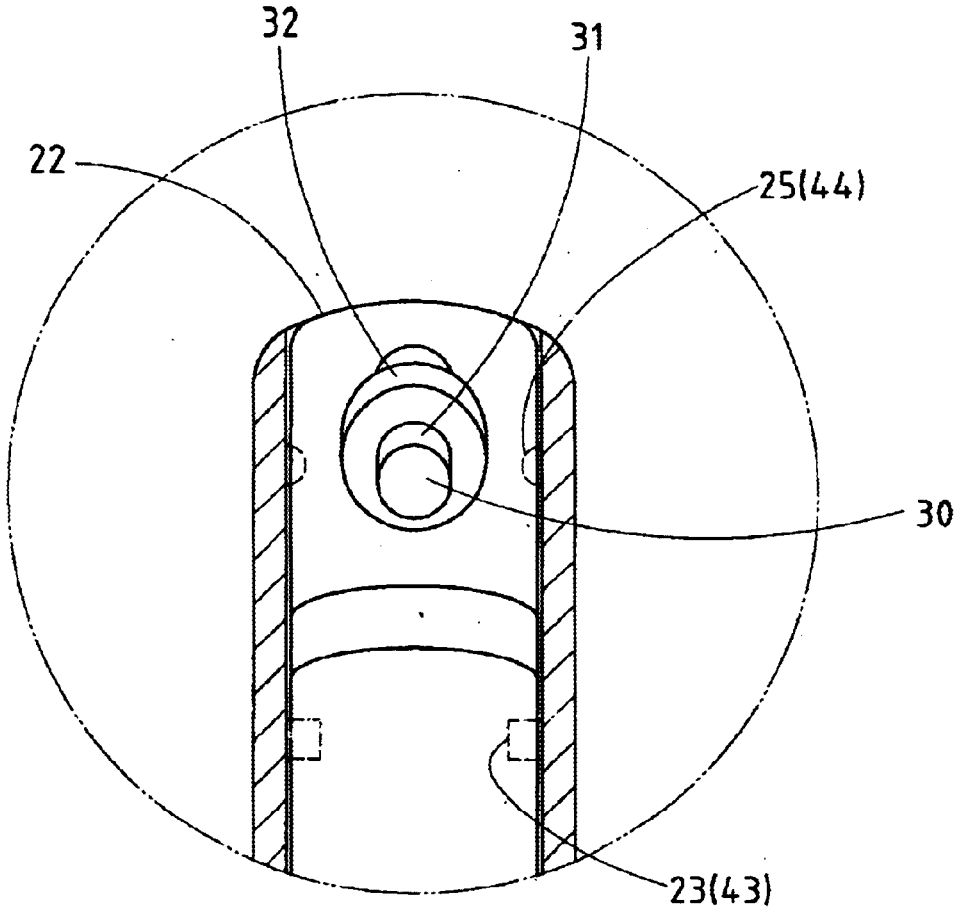
FIG. 4 shows a top schematic view of the movable shield structure of the preferred embodiment of the present invention.

The movable shield 40 is pivotally fastened at a bottom end with the trigger lever 20 and is provided at a top end with a receiving space 41 corresponding in location to the flow control valve rod 30 and the adjustment nut 32. As the movable shield 40 is turned toward the rear end of the barrel 121 the flow control valve rod 30, the adjustment nut 32, and the trigger portion 22 of the trigger lever 20 are received in the receiving space 41 of the movable shield 40. As a result, the flow control valve rod 30, the adjustment nut 32, and the trigger portion 22 are kept out of sight, as shown in FIG. 2. As the movable shield 40 is turned away from the rear end of the barrel 12, the flow control valve rod 30, the adjustment nut 32, and the trigger portion 22 are exposed, as shown in FIG. 3.

The movable shield 40 embodied in the present invention is provided in the inner wall of two opposite sides 42 with a pivoting projection 43, while the trigger lever 20 is provided in the outer wall of two opposite sides thereof with a pivoting cavity 23 corresponding in location to pivoting projection 43. The movable shield 40 is pivoted to the trigger lever 20 by the two pivoting projections 43 which are rotatably retained in the two pivoting cavities 23 of the trigger lever 20.

The receiving space 41 of the movable shield 40 is provided in two opposite inner walls with a semicircular knob 44, whereas the trigger portion 22 of the trigger lever 20 are provided in two opposite outer walls with a semicircular cavity 25 corresponding in location to the semicircular knob 44. As the trigger portion 22 of the trigger lever 20 is concealed in the receiving space 41 of the movable shield 40, the two semicircular knobs 44 of the movable shield 40 are removably retained in the two semicircular cavities 25 of the trigger portion 22 of the trigger lever 20. It must be noted here that the receiving space 41 of the movable shield 40 is defined by the two sides 42 of the movable shield 40.

The trigger lever 20 is provided in the outer surface of two opposite sides of the top segment with a recess 24 which has a depth corresponding to a thickness of the two sides 42 of the movable shield 40. In addition, the outer surface of the rear end of the barrel 12 is provided with a recess 13 corresponding to the thickness of the two sides 42 of the movable shield 40. Such a design as described above is intended to enable a flush fit of the movable shield 40 at the time when the movable shield 40 covers completely the flow control valve rod 30, the adjustment nut 32, and the trigger portion 22.

The movable shield 40 serves to provide the flow control valve rod 30, the adjustment nut 32, and the trigger portion 22 with protection against dust and rust. In addition, the movable shield 40 serves to enhance the overall esthetic effect of the pistol-type nozzle of the present invention.

The embodiment of the present invention described above is to be regarded in all respects as being illustrative and nonrestrictive. Accordingly, the present invention may be embodied in other specific forms without deviating from the spirit thereof. The present invention is therefore to be limited only by the scope of the following claims.

I claim:

1. A pistol-type nozzle comprising:

a handle;

a barrel fastened at a rear end to a top end of said handle;

a flow control valve rod extending out of the rear end of said barrel and comprising a threaded segment on which an adjustment nut is fastened;

a trigger lever comprised of, at a top end, a trigger portion and fastened pivotally to said handle such that said trigger portion presses against said adjustment nut of said flow control valve rod; and a movable shield comprised of a receiving space dimensioned to receive therein said flow control valve rod, said adjustment nut, and said trigger portion of said trigger lever whereby said movable shield is pivoted with said trigger lever such that said movable shield can be turned to conceal said flow control valve rod, said adjustment nut and said trigger portion in said receiving space of said movable shield.

2. The pistol-type nozzle as defined in claim 1, wherein said movable shield comprises two sides opposite to each other and defines said receiving space of said movable shield, said two sides being provided in an inner surface with a pivoting projection; wherein said trigger lever is provided in two opposite outer surfaces with a pivoting cavity; wherein said movable shield is pivoted with said trigger lever in such a way that said two pivoting projections of said two sides of said movable shield are rotatably retained in said two pivoting cavities of said trigger lever.

3. The pistol-type nozzle as defined in claim 2, wherein said movable shield is provided in the inner surface of said two sides thereof with a locating knob; wherein said trigger lever is provided in two opposite outer surfaces of said trigger portion thereof with a locating cavity corresponding in location to said locating knob whereby said locating knob is removably retained in said locating cavity at the time when said movable shield covers said flow control valve rod, said adjustment nut, and said trigger portion of said trigger lever.

4. The pistol-type nozzle as defined in claim 2, wherein said trigger lever is provided in the two opposite outer surfaces with a recess having a depth corresponding to a thickness of the two sides of said movable shield; wherein said barrel is provided in an outer surface of the rear end with a recess having a depth corresponding to the thickness of the two sides of said movable shield; wherein said two sides of said movable shield are level with the two opposite outer surfaces of said trigger lever and with the outer surface of the rear end of said barrel at the time when said movable shield covers said flow control valve rod, said adjustment nut, and said trigger portion of said trigger lever.

* * * * *